US010479114B2

(12) United States Patent
Bryde et al.

(10) Patent No.: US 10,479,114 B2
(45) Date of Patent: Nov. 19, 2019

(54) VACUUM TABLE FOR FLAT BED PRINTER

(71) Applicant: Océ Holding B.V., Venlo (NL)

(72) Inventors: Ryan C. Bryde, Venlo (NL); Alexander Rybolov, Venlo (NL); Aaron Mak, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/833,608

(22) Filed: Dec. 6, 2017

(65) Prior Publication Data

US 2018/0093500 A1 Apr. 5, 2018

Related U.S. Application Data

(63) Continuation of application No. PCT/EP2017/071605, filed on Aug. 29, 2017.

(30) Foreign Application Priority Data

Sep. 2, 2016 (EP) ..... 16186922

(51) Int. Cl.
*B41J 11/00* (2006.01)
*B26F 1/00* (2006.01)

(52) U.S. Cl.
CPC ..... *B41J 11/0085* (2013.01); *B26F 1/00* (2013.01)

(58) Field of Classification Search
CPC ..... B41J 11/0085; B41J 11/06; B41J 11/008; B41J 3/28; B26F 1/00; B65H 2406/351; B65H 2406/42
See application file for complete search history.

(56) References Cited

U.S. PATENT DOCUMENTS 8,944,586 B2 * 2/2015 Chung ..... B41J 3/28 347/101
2006/0280543 A1 12/2006 Hilpert

FOREIGN PATENT DOCUMENTS

DE 10 2014 104 666 A1 10/2015
EP 2 351 649 A2 8/2011
JP 2014-188792 A 10/2014
(Continued)

OTHER PUBLICATIONS

European Search Report issued in EP 16 18 6922, dated Mar. 3, 2017.

(Continued)

*Primary Examiner* — Geoffrey S Mruk
(74) *Attorney, Agent, or Firm* — Birch, Stewart, Kolasch & Birch, LLP

(57) ABSTRACT

A vacuum table for a wide format printing system, wherein a medium support surface with vacuum holes therein is spaced apart from a bottom plate by a spacer array. The spacer array is formed by an integrally formed spacer structure with a first and a second longitudinal plate positioned between the bottom plate and the medium support surface. These plates comprise a plurality of air flow through-holes as well as a top support edge and a bottom support edge extending equidistantly to one another. A connection element connects the first longitudinal plates and is positioned between the bottom support plane and the top support plane. The use of longitudinal plates allows the spacer to be cheaply and easily produced by punching. The plates further offer the advantage of a low air flow resistance while maintaining a high rigidity of the spacer array.

20 Claims, 7 Drawing Sheets

(56) References Cited

FOREIGN PATENT DOCUMENTS

| | | | |
|---|---|---|---|
| WO | WO 2005/032773 | A2 | 4/2005 |
| WO | WO 2014/202203 | A1 | 12/2014 |
| WO | WO 2015/185085 | A1 | 12/2015 |

OTHER PUBLICATIONS

International Search Report (PCT/ISA/210) issued in PCT/EP2017/071605, dated Nov. 9, 2017.
Written Opinion of the International Searching Authority (PCT/ISA/237) issued in PCT/EP2017/071605, dated Nov. 9, 2017.

* cited by examiner

VACUUM TABLE FOR FLAT BED PRINTER

BACKGROUND OF THE INVENTION

1. Field of the Invention

The invention relates to a vacuum table, a spacer for a vacuum table, and a method of forming a vacuum table.

2. Description of Background Art

A vacuum table of a printing system comprises a medium support surface for holding a while it is being printed by print heads moving over the medium. The medium is held onto the medium support surface by a suction force applied via vacuum holes in the medium support surface. This prevents the medium from coming into contact with the print heads, thereby damaging the medium or the print heads. The medium support surface is vertically spaced apart from a bottom surface of the vacuum table by a spacer. The spacer provides an air flow distribution manifold for providing a vacuum to all the vacuum holes in the medium support surface, such that only a single suction system needs to be applied. The spacer further defines a support plane for the medium support surface. The flatness of the medium support surface determines the print quality as deviations in the distance between the medium and the print head can cause visible print artifacts. Generally, a metal honeycomb structure is used as a spacer. Such a honeycomb structure may be easily formed from a panel consisting of multiple layers of metal sheet. Each sheet is fixed to the sheet below it by longitudinal strokes of adhesive, which are alternating with strokes wherein no adhesive is applied. Air flow holes are drilled through the panel. By cutting a strip from said panel and expanding it, by e.g. pulling the top and bottom sheet apart, a honeycomb structure is formed.

Though such a honeycomb provides a lightweight and rigid spacer, it possesses several drawbacks. The overall air resistance through the spacer is relatively high, requiring a high power suction system to provide adequate suction to all the vacuum holes. Additionally, the drilling of the air flow holes is a time consuming process, as in practice several hundreds of said air flow holes need to be drilled.

SUMMARY OF THE INVENTION

It is an object of the invention to provide a low cost vacuum table.

In accordance with the present invention, a vacuum table according to claim 1, a spacer according to claim 11, and a method according to claim 12 are provided.

In a first aspect, the present invention provides a vacuum table for holding print media while printing. The vacuum table comprises:

- a bottom plate;
- a medium support surface spaced apart from the bottom plate and comprising a plurality of vacuum holes; and
- a spacer array comprising at least one integrally formed spacer structure which comprises:
  - a first and a second longitudinal plate positioned between the bottom plate and the medium support surface, wherein the first and second longitudinal plate comprise:
    - a plurality of air flow through-holes;
    - a top support edge and a bottom support edge formed by lateral sides of the first and the second longitudinal plate and extending equidistantly with respect to one another, such that a top support plane for the medium support surface is defined by the top support edges of the first and the second longitudinal plate and that a bottom support plane for the bottom plate is defined by the bottom support edges of the first and the second longitudinal plate;
  - a connection element positioned between the first longitudinal plate and the second longitudinal plate when viewed parallel to the top and/or bottom support plane, which connection element connects the first longitudinal plate and the second longitudinal plate to one another, such that the connection element is positioned between the bottom support plane and the top support plane when viewed perpendicular to the top and/or bottom support plane.

The medium support surface is preferably formed by a very flat or planar top plate. As such, the top plate must by suitably supported by the spacer array to ensure a homogenous height or flatness of the top surface of the top plate. The spacer array is formed of plates, which may be accurately dimensioned by e.g. punching. This ensures a homogeneous thickness of the spacer array over the full area of the top plate. Additionally, the use of plates allows for relatively large through-holes without negatively affecting the rigidity of the spacer array. This provides a relatively low air resistance of the spacer array, allowing for a high through-flow of air through the vacuum table. The plates with the through-holes may be cheaply and easily manufactured in a single punching step, reducing the costs of producing the vacuum table according to the present invention.

The plates are connected to one another by a connection element, such as a further plate or a connection bridge. The connection element extends between two or more plates within the volume between the top and bottom plate. The connection element does not extend above or below the top or bottom support edges of the plate, ensuring that the medium support surface on the top plate remains flat. As such, a rigid three-dimensional spacer array structure is formed. The production of the three-dimensional spacer array is relatively easy, as the spacer structure may be formed by punching and bending of a plate material. In a preferred embodiment, the spacer structure may be integrally formed from a single type of plate. A further advantage is that the three dimensional spacer array is self supporting, such that during assembly no additional means are required for supporting a the spacer structure in its desired orientation. As such, the number of components for the vacuum table and the assembly time for forming such a vacuum table are reduced. Due to the high through-flow of air, the suction system of the vacuum table consumes relatively little power. These latter aspects lead to a reduction in the overall costs of the vacuum table according to the present invention. Thereby the object of the present invention has been achieved.

More specific optional features of the invention are indicated in the dependent claims.

In an embodiment, the connection element, the first, and the second longitudinal plate are formed from a single element. Integrally formed herein implies the spacer structure is formed from or as a single element. The spacer structure may further be formed of a single material, such as metal. For producing the spacer structure, the single element may be processed to assume the appropriate shape or form of the spacer structure according to the present invention. Preferably, the connection element, the first, and the second longitudinal plate are formed from a single plate element. By punching and bending the single plate element or material, a three-dimensional spacer structure according to the present invention may be easily and cheaply provided.

In a preferred embodiment, the top support plane (or the top plate) and the bottom support plane (or the bottom plate) are positioned spaced apart from one other, such that an inner volume or chamber is defined between them. The top support edges of the plate are positioned in the top support plane and the bottom support edges in the bottom support plane. The connection member is positioned within the inner volume, without extending beyond the top and bottom support planes. Thereby, the operator need not be concerned by affecting the eventual flatness of the top plate when installing the connection elements.

In an embodiment, the connection element is connected to the first and the second longitudinal plate at a connection point, line or surface positioned between the top support edge and the bottom support edge of the first and the second longitudinal plate. The connection elements are designed such that, upon their connection to the plates, said connection elements are fully contained within the inner volume of the vacuum table. The support element is preferably formed by a channel or recess extending from the top or bottom support edge of the plate. The channel then comprises a support surface for supporting the connection element. The support surface with the connection point may thus be formed by an end of the channel. The channel may act a guide for the guiding the connection element to the support surface, thereby facilitating an easy assembly of the spacer array. Alternatively, the connection point may be formed by an extension on a surface of the plate positioned in between the plate's edges.

In another embodiment, the connection element is connected to the first and the second longitudinal plate at such angles that the first and the second longitudinal plate together with the connection element connected thereto form a stabile three-dimensional spacer structure. In an assembled state, the connection element extends at a, preferably right, angle away from the plane of the plate. In a preferred embodiment, the plates are aligned with respect to one another in a first direction within the inner volume, whereas a plurality of connection elements is aligned with respect to one another in a second direction. Due to the angle of the connection element, two neighboring plates may be connected to one another into stable three-dimensional structure.

In a preferred embodiment, the connection element is formed by a longitudinal connection plate. The connection plate comprises one or more through-holes. The width (or height in the assembled state) of the plate is preferably equal (or less) to that of the first and a second longitudinal plates. The connection plate is provided with a plurality of channels extending from one or both of the longitudinal edges of the connection plate.

The channels extend at a, preferably right angle, from an edge into the connection plate. The channels are dimensioned in correspondence to channels provided in the first and second longitudinal plates for interlinking both plates. The spacer array may then be assembled by engaging a channel of the connection plate with a channel of the first or second longitudinal plate. Both plates thereby effectively slide into another, such that, when viewed from above during use, a cross-shaped cross-section is formed. The connection plate is then supported on the first or second longitudinal plate at the interlinking channels. In an advantageous embodiment, the connection plate is identical to the first and second longitudinal plates, such that the spacer array may be formed of a single plate type. The channel then extends into a plate perpendicular to the plate's longitudinal edge over half the plate's width. The production costs of the spacer array are thereby reduced, as only a single punch needs to be manufactured for forming the plates.

In a further embodiment, the first and second longitudinal plate comprise a plurality of support legs spaced apart from one another in a longitudinal direction of the first and the second longitudinal plate. The free support ends of said support legs are aligned with respect to one another to define the bottom support edge. The bottom edge of the plate (during use) is provided with a plurality of protrusions, which are spaced apart from one another along said edge. Thereby, a recess is formed between two neighboring protrusions. In the assembled state, the bottom sides or edges of the protrusions are in contact with the bottom plate, while a recess spaces a respective section of the plate around the recess apart from the bottom plate, forming an opening between the bottom plate and the longitudinal plate. By providing alternating protrusions and recesses along an edge of the plate a suitable support surface may be formed, which allows for easy placement of the spacer array on the bottom plate. A straight edge requires a very clean or smooth as the straight edge will balance on any unevenness on or in the surface of the bottom plate. The recesses allow for placement of the spacer array with less concern for cleanness or smoothness of the bottom plate. Thereby, assembly of the vacuum table is simplified and sped up. The support legs and the plate are preferably positioned within a single plane, allowing the plate and support legs to be integrally punched from a plate material.

In a preferred embodiment, the connection element is positioned between two neighboring or adjacent support legs, in the longitudinal direction of the first and/or second longitudinal plate. A through-hole extends between laterally opposing support legs, when viewed from above during use. Said through-hole is positioned in between two connection bridges in the longitudinal direction. During use, a recess between two neighboring protruding support legs is thereby positioned below the connection element. The plate and the connection element may then be integrally formed by punching and bending (or folding) the connection element with respect to the plate such that the connection element extends away from the plane of the plate. The connection element, the first, and the second longitudinal plate may even be integrally punched from a single plate material, followed by two bending steps for forming a three-dimensional self-supporting spacer. As such, the spacer array may be formed with low-cost production methods.

In a preferred embodiment, the free support ends of the support legs and the air-flow through-holes of the first and the second longitudinal plate are positioned on opposite sides with respect to the connection element. This ensures the connection element will not extend above or below the top and bottom support edges, ensuring a flat medium support surface on the top plate. In the width direction (or the height direction during use) of the plate, the connection element divides the plate in a support leg region and a through-hole region. Preferably, the length of the support legs in a width direction of a longitudinal plate is small compared to the remaining surface of the plate, which surface may then be used to provide larger or more through-holes to increase the air flow through the spacer array. The relatively small recesses do not significantly reduce the rigidity of the plate. The support legs thus during use extend at least partially below the connection element, whereas the though-holes in the plates are preferably positioned above said connection element.

In an embodiment, the connection element comprises a connection bridge provided with at least one air flow through-hole. The connection bridge extends between two neighboring longitudinal plates. The one or more through-holes in the connection bridge allow for an air flow in the vertical direction during use. The suction system may thus be connected to a suction opening in the bottom plate. The spacer array then offers little air resistance in both the horizontal and vertical directions.

A vacuum table for a flatbed printing system is relatively large and its inner volume is most easily filled by providing a plurality of longitudinal plates in a first direction, preferably a width or length direction of the vacuum table. One or more connection plates then extend in a second direction, preferably perpendicular to the first direction, between neighboring plates. Therefore in a preferred embodiment, the first and the second longitudinal plate extend substantially parallel to one another, and wherein the connection element comprises a connection plate extending substantially perpendicular to a plane of the first and of the second longitudinal plate. The width or length of the longitudinal plates preferably corresponds to the width or length of the vacuum table.

In a further embodiment, the first and second longitudinal plates are respectively connected to the connection element at a first and a second bend line, such that the first longitudinal plate extends at a first angle with respect to the connection element and the second longitudinal plate extends at a second angle with respect to the connection element, such that an air flow volume is defined by the connection element, the first longitudinal plate and the second longitudinal plate. The plates are preferably bent, such that one plate faces the other. The air flow through-holes in the first longitudinal plate are positioned with respect to the air flow through-holes in the second longitudinal plate, such that air is allowed to flow in a straight line through one of the air flow through-holes in the first longitudinal plate, into and through the air flow volume, and through one of the air flow through-holes in the second longitudinal plate. This allows the above described spacer to be integrally formed by punching a plate material. The punch forms the first and second longitudinal plates with one or more connection bridges extending between them, all positioned within a plane of the plate material. Curved through-holes are punched in a central region of the plate material between the first and second longitudinal plates, such that the support legs and connection bridges are formed in the central region. The connection bridges are aligned on each plate along a bend line parallel to the edges of the plates. The plates are then bent towards one another to form a three-dimensional spacer. The bending positions the through-holes in the first longitudinal plate opposite to those in the second longitudinal plate to allow air to pass through the spacer in a horizontal direction during use. In a preferred embodiment, the plates are bent along the bend line over right angles. The first and the second longitudinal plate with the connection element connected thereto then comprise a substantially U-shaped cross-sectional profile, wherein the side legs of the H-shape are formed by the first and second longitudinal plate and the central portion of the H-shape is formed by the connection bridge. This provides a rigid and stable spacer for supporting the top plate. It will be appreciated that within the scope of the present invention other angles may be applied for bending the plates over the bend line.

In a further embodiment, the connection element or bridge is connected to the first longitudinal plate at the first bend line. This connection or fold forms the connection point for supporting the connection element. The connection element may be similarly connected to the second longitudinal plate.

In another embodiment, the first longitudinal plate, the second longitudinal plate, and the connection element are an integrally formed spacer structure, preferably formed of a bendable material such as metal, steel, or suitable plastics. Such cheap and readily available materials may be applied to produce a cheap spacer array.

In a further embodiment, the spacer structure is provided in between and connected to the bottom plate and the medium support surface as a spacer.

In a further aspect, the present invention provides a spacer for use in a vacuum table according to any of the previous claims, comprising an integrally formed spacer structure which comprises:

a first and a second longitudinal plate, comprising:

a plurality of air flow through-holes;

a top support edge and bottom support edge formed by lateral sides of the first and the second longitudinal plate, wherein the top support edge and bottom support edge extend equidistantly with respect to one another, such that a top support plane is defined by the top support edges of the first and the second longitudinal plate and that a bottom support plane is defined by the bottom support edges of the first and the second longitudinal plate;

a connection element positioned between the first longitudinal plate and the second longitudinal plate when viewed parallel to the top and/or bottom support plane, which connection element connects the first and second longitudinal plate to one another, wherein the connection element is connected to the first and second longitudinal plate between the top support edge and the bottom support edge of the first and the second longitudinal plate when viewed perpendicular to the top and/or bottom support plane. As explained above, the spacer may be cheaply and easily formed by punching and bending. Said production process allows for a cheap yet accurately dimensioned spacer for supporting a planar top plate.

In another aspect, the present invention provides a method of forming a spacer assembly vacuum table of a printing system, comprising the steps of:

punching a plate material to form a base plate comprising a longitudinal plate with plurality of air flow through-holes and substantially parallel and equidistant top and bottom support edges; wherein the base plate comprises a first and second longitudinal plate sections which are connected to one another via a connection plate section positioned between the first and second longitudinal plate section, the method further comprising the steps of:

bending the first longitudinal plate section over a first angle around a first bend line positioned between the first longitudinal plate section and the connection plate section, such that the connection plate section is positioned in between the top and bottom support edges of the first longitudinal plate section when viewed perpendicular to said top and bottom support edges; and bending the second longitudinal plate section over a second angle around a second bend line positioned between the second longitudinal plate section and the connection plate section, such that the connection plate section is positioned in between the top and bottom support edges of the second longitudinal plate section when viewed perpendicular to said top and bottom support edges.

The plate material is punched to define the longitudinal plate sections. The punched plates comprise a constant width to provide a suitable flatness to the top surface of the top plate. The bent plates are then mounted on the top or bottom plate. The plates provide a relatively large surface for forming relatively large through-holes, such that the air resistance of the vacuum table is relatively low. This is beneficial for reliable media holding as well as the power consumption of the suction system. The low air resistance further improves the homogeneity of the suction force over the media support surface. The longitudinal plate sections are connected to one another by the connection element section, which has been integrally formed with said plate sections. The connection element section extends through and within the inner volume of the vacuum table, thereby not disturbing the flatness of the top plate. As such, a relative cheap and easy method for forming a spacer for a vacuum table is provided. Thereby, the object of the present invention has been achieved.

In another embodiment, the step of punching comprises punching a first and a second longitudinal plate section each comprising a plurality of air flow through-holes and substantially parallel top support edges, wherein the first and second longitudinal plate sections are connected to one another via a connection plate section positioned between the first and second longitudinal plates, the method further comprising the steps of:

bending the first longitudinal plate section over a first angle around a first bend line positioned between the first longitudinal plate section and the connection plate section and extending parallel to the top support edges; and bending the second longitudinal plate section over a second angle around a second bend line positioned between the second longitudinal plate section and the connection plate section and extending parallel to the top support edges.

The spacer structure may thus be integrally formed by a single punching step. Bending the first and second longitudinal plate sections transforms the base plate into a rigid self-supporting three-dimensional structure, which may be easily mounted onto the vacuum table during assembly. By bending the longitudinal plate sections on either side of the connection plate section an inner volume is formed between these plate sections through which air may travel unimpeded in the longitudinal direction of the plates, resulting in very low air resistance in said direction.

In a further embodiment, the step of punching further comprises punching a plurality of air flow trough-holes in the connection plate section, wherein at least one of said air flow through-holes has a first curved through-hole edge intersecting the first bend line at two positions spaced apart along the first bend line, such that a first support leg is formed extending from the first longitudinal plate section across or from the first bend line. The curved through-hole is preferably positioned in the central region between two neighboring connection bridges sections. The step of bending the first longitudinal plate section further comprises bending the first longitudinal plate material around the first bend line, such that the first longitudinal plate section with the first support leg parallel thereto is positioned at the first angle with respect to the connection bridge. The base plate comprises a central region positioned between the first and second longitudinal plate sections. The first bend line is positioned between the central region and the first longitudinal plate section, while the second bend line is positioned between the central region and the second longitudinal plate section. In the base plate, the support legs thus extend from or across the bend line into central region. The support legs are provided on opposite sides of a through-hole in the central region. Neighboring through-holes for forming the support legs are separated from one another by a connection element or bridge, which extends across the central region from the first longitudinal plate section to the second longitudinal plate section. The first and second longitudinal plate sections are bent around their respective bend lines, such that the free top support edges of the plates rotate around their respective bend lines. Similarly, the support legs on the plate sections are rotated around the bend lines. Thereby, the support legs are positioned on an opposite side of the connection element section (or central region) with respect to the support edges. In use, the connection element is thus positioned between the top support edges of the respective plate sections and the support legs (or the bottom edges thereon). As such, a stabile spacer may be formed in a fast and cheap production process.

In another embodiment, at least one of the plurality of air flow trough-holes punched in the connection bridge section has a second curved through-hole edge intersecting the second bend line at two positions spaced apart along the second bend line, such that a second support leg is formed extending from the second longitudinal plate section across the second bend line. The step of bending the second longitudinal plate section further comprises bending the second longitudinal plate material around the second bend line, such that the second longitudinal plate section with the second support leg parallel thereto is positioned at the second angle with respect to the connection bridge section, wherein the top support edges of the first and second longitudinal plates are positioned in a top support plane and the bottom support edges of the first and second support legs are positioned in a bottom support plane substantially parallel to the top support plane. The support leg is thus formed to rotate along with the first or second longitudinal plate section around their respective bend line, when bending the base plate. The curved through-hole edges ensures that during and after bending the support legs and the longitudinal are positioned in the same plane, which plane rotates during bending. It will be appreciated that within the scope of the present invention additional steps may be performed for repositioning, rotating, or further bending the plates and/or support legs in a desired orientation.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
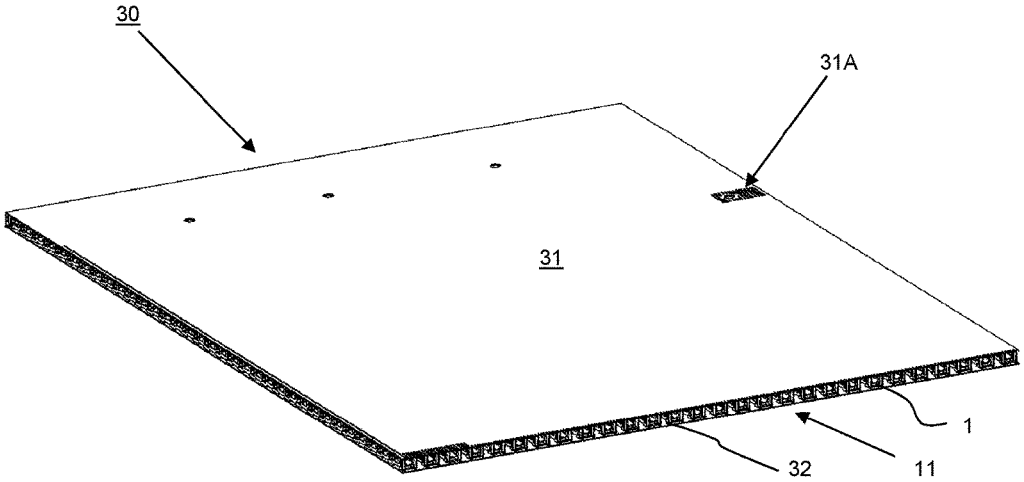
FIG. 1 is a perspective view of a vacuum table according to the present invention.

The present invention will now be described with reference to the accompanying drawings, wherein the same reference numerals have been used to identify the same or similar elements throughout the several views.

FIG. 1 shows a vacuum table 30 according to the present invention. The vacuum table 30 comprises a medium support surface 31, formed by a flat top plate 31 provided with a plurality of vacuum holes 31A. The vacuum table 30 further comprises a bottom plate 32. The top plate 31 and the bottom plate 32 are positioned at a vertical distance with respect to one another by an array 11 of spacers 1. The spacers 1 in the spacer assembly 11 positions the top plate 31 equidistant from the bottom plate 32, such that the top surface 31 is planar or flat, free of variations or irregularities in the height of the medium support surface 31. This ensures that media on the medium support surface 31 are level, smooth, and flat while printing, thereby preventing contact between the print heads moving on a carriage (not shown) over the medium. Local variations in the height of the medium may cause the medium to come into contact with the print heads, resulting in the smearing of ink across the medium or even damage to the print heads. Unevenness in the medium support surface 31 may further result in artifacts in the printed image, especially when using thin or flexible media, which easily conform to the geometry of the medium support surface 31. Further, rigid media may be improperly secured unto the vacuum table 30, by vacuum leaks originating from local variations in the height of the top surface 31, or by unstable positioning or balancing of the rigid media on such local height variations.

Figure 2:
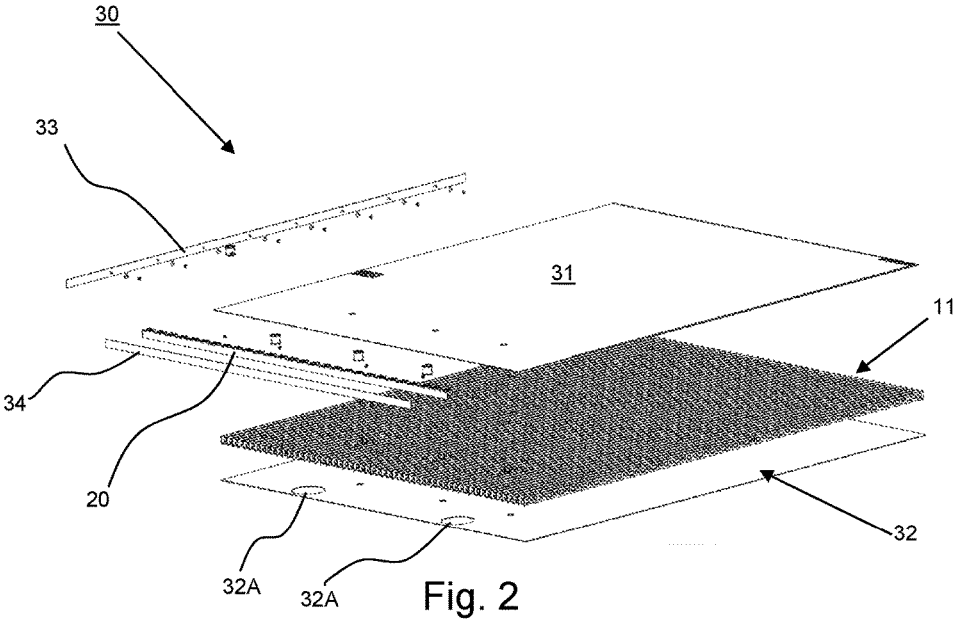
FIG. 2 is an exploded view of the vacuum table in FIG. 1.

FIG. 2 shows an exploded view of the vacuum table 30 in FIG. 1. The bottom plate 32 is provided with one or more suction system openings 32A, 32B, which can be connected to a suction system (not shown), such as a pump or fan. The spacer array 11 in FIG. 2 further acts as an air distribution manifold 11, through which air from each of the vacuum holes 31A in the top surface 31 may be directed to one of the suction system openings 32A, 32B and from there to the suction system. The spacer array 11 is formed from a plurality of longitudinal spacers 1, which extend across the length or width of the table 30. The spacers 1 are easily positioned into an array 11 by means of spacer positioners 20 at lateral sides of the table 30. The spacer positioners 20 define the distance between adjacent spacers 1 and allow for a quick assembly of the spacers 1 into an array 11. The side edges 33, 34 of the table 30 are sealed by side plates 33, 34 to prevent air from leaking into the table 30 and affecting the vacuum.

Figure 3:
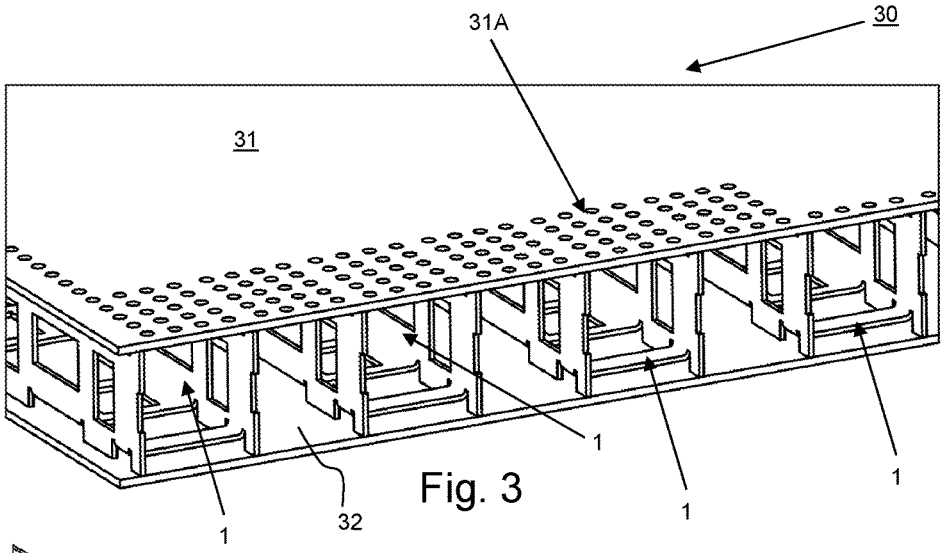
FIG. 3 is a close-up perspective view of a side edge of the vacuum table in FIG. 1.

FIG. 3 shows in more detail the spacer array 11 positioned between the top and bottom plates 31, 32. The longitudinal spacers 1 are spaced apart from one another and aligned along a width or length direction of the vacuum table 30. Each spacer 1 comprises a H or U-shaped cross-section wherein the top plate 31 is supported on the ends of the sides or legs of the H-shaped spacer 1. To form a flat and even medium support surface 31, said ends are positioned in a single two dimensional top support plane. Likewise, the bottom support legs of the spacer define a bottom support plane. Each spacer 1 is further positioned by the spacer positioner 20 in between rows of vacuum holes 31A, such that no vacuum holes are blocked or partially shut off 31A by the spacer array 11.

Figure 4A:
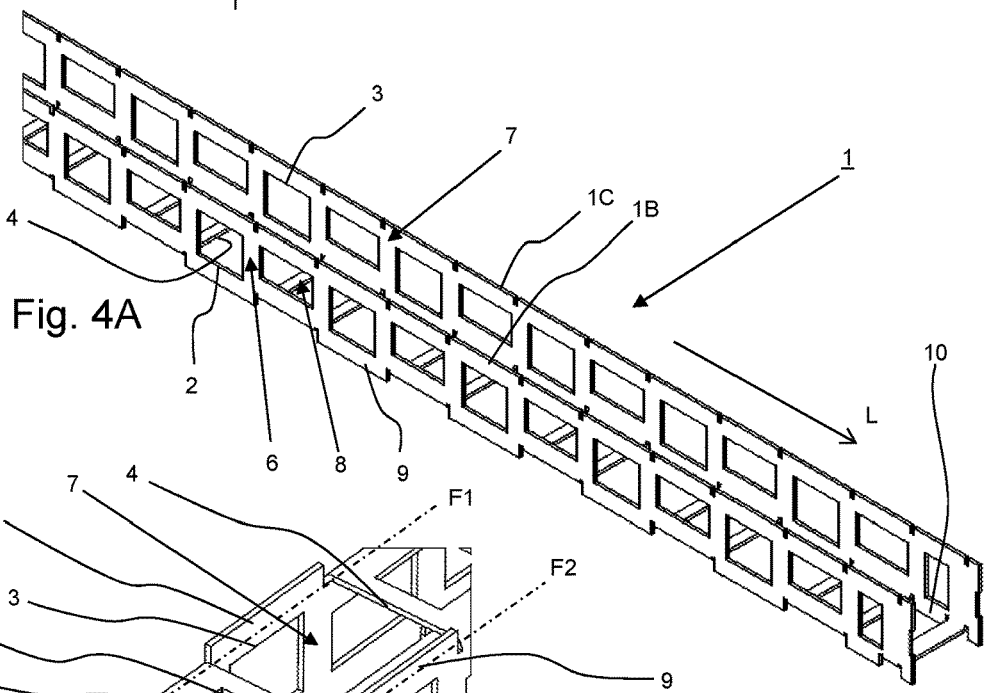
FIG. 4A-D are respectively a perspective top view, a perspective bottom view, and side view, and a front view of a spacer according to the present invention.

FIG. 4A shows an individual spacer 1. The spacer 1 has a top U-shaped cross-section formed by a first longitudinal plate 6 with through-holes 2 provided therein, a second longitudinal plate 7 with through-holes 3 provided therein, and a connection bridge 8 with through-holes 4 provided therein. The first and second longitudinal plates 6, 7 as well the connection bridge 8 consist of flat, preferably longitudinal, plate sections 6, 7, 8. In FIG. 4A these plate sections 6, 7, 8 are connected to one another under right angles. The connection bridge 8 or central region 8 is positioned between and connects the first and second longitudinal plates 6, 7. The U-shape is formed by bending or folding the longitudinal plates 6, 7 around their respective bend lines F1, F2, which in FIG. 4B extend parallel to the longitudinal direction L of the spacer 1. The U-shaped profile of the spacer 1 lends rigidity to the spacer 1 and allows each spacer 1 to be positioned separately on the bottom and/or top plate 31, 32.

Each plate section 6, 7, 8 comprises a plurality of through-holes 2, 3, 4 to optimize the through-flow of air through the spacer array 11. This reduces the air resistance of the spacer array 11. Due to the U-shaped profile the resistance in the longitudinal direction L of the spacer 1 is small. The large through-holes 3, 4 provide a low air resistance in the remaining horizontal direction, whereas the through-holes 7 allow for a high through-flow of air in the vertical direction. In consequence the requirements for the suction system are reduced such that power consumption is reduced and/or a cheaper pump or fan may be applied.

Figure 4B:
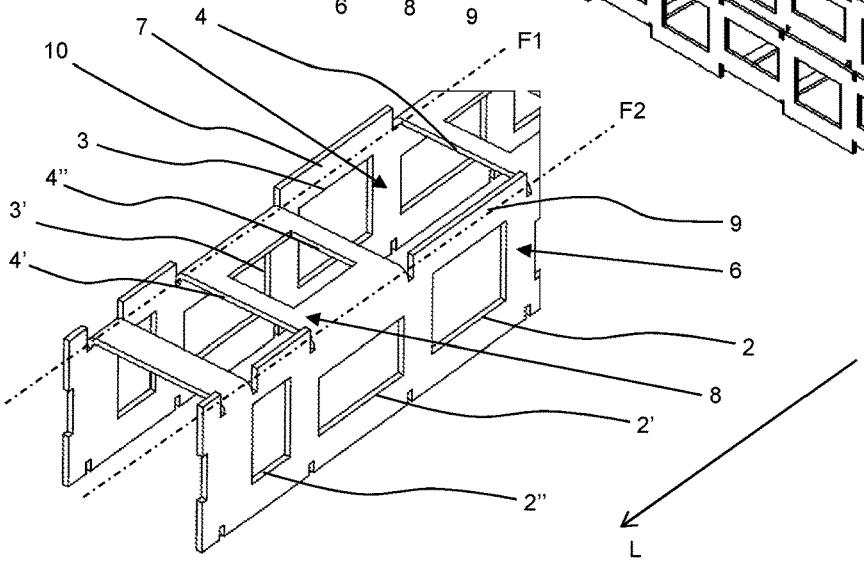

In FIG. 4B, it can be seen that through-holes 2, 2', 2", 3, 3', 3", 4, 4', 4" of different dimensions or sizes may be applied to each of the regions 6, 7, 8 to achieve a high through-flow of air with significantly reducing rigidity. The connection bridge or plate section 8 is provided with two alternating types or shapes of through-holes 4, 4', 4". The first through-hole type 4, 4' provides the opening whereby the support legs 9, 10 are formed. The second type 4" provides an air flow opening in the connection bridge 8, i.e. in the plate material 8 connecting the plates 6, 7.

Through-holes of the first type 4, 4' are similar in shape, but have different dimensions: the length in the longitudinal direction L of the opening 4' is smaller than that of the opening 4 in order to fit the opening 4' on the remaining length of the spacer 1. Through-holes 4, 4' extend from the first bend line F1 to the second bend line F2. The width of the first type through-hole 4, 4' is then similar or equal to the width of a connection bridge 8. The lateral side edges of the through-holes 4, 4' are curved in a U-shape for forming the support legs 9, 10. A middle section of said lateral edges extends parallel to the bend lines F1, F2 for forming support surfaces upon which the spacer 1 is supported on the bottom plate 32. At their upstream and downstream ends, the lateral side edges of the opening 4, 4' curve towards the bend line F1, F2. These curves may run perpendicular, or in a different embodiment at an angle, to the bend lines F1, F2. In FIG. 4B, the U-shaped side lateral edges extend to and across the bend lines F1, F2 to or into the plate material of the longitudinal plate sections 6, 7. By intersecting a bend line F1, F2 at two longitudinally spaced apart points, said bend line F1, F2 and the lateral side edge of the through-holes 4, 4' define and circumscribe a support leg 9, 10 of the plate material. The support legs 9, 10 extend parallel to the longitudinal plate sections 6,7 across the bend lines F1, F2 into the area of the central region of the connection plate section 8, specifically into the openings 4, 4'. When bending one of longitudinal plate sections 6, 7 around its bend line F1, F2, the support legs 9, 10 are rotated around an axis parallel to the bend line F1, F2 (or around the bend line F1, F2 itself). During bending the support legs 9, 10 rotate with their respective plate 6, 7 (i.e. are positioned within the same rotating plane). The angle over which the support legs 9, 10 rotate is the same or similar to the bending angle ($\alpha_1$ or $\alpha_2$ in FIG. 4D) over which the longitudinal plate sections 6, 7 are bent around said bend line F1, F2. This ensures that the support legs 9, 10 while rotating extend parallel to the plane of their corresponding longitudinal plate section 6, 7. This rotation positions the support surface (top surface of the legs 9, 10 in FIG. 4B and the bottom surface of the legs in FIG. 4A) at a vertical distance from the connection plate section 8, such that a three dimensional structure 1 is formed. The spacer 1 may thus be supported on the support legs 9, 10. In FIGS. 4A, D it can be clearly seen that the support surfaces of the support legs 9, 10 extend below the plane of the connection bridge 8.

The second through-hole type 4" in FIG. 4A is rectangular, though in practice it may be any desired shape. This second through-hole type 4" is positioned in the plate material of the connection plate section 8, such that this through-hole 4" is spaced apart from the bend lines F1, F2 which define the connection plate section or connection bridge 8. The plate material of the connection bridge 8 extends around the through-hole 4" and connects the longitudinal plates 6, 7 to one another. Where this plate material overlaps the bend lines F1, F2, the plate material is bent to obtain the U-shaped cross-section of the spacer 1. The through-holes 4, 4', 4" are in use positioned parallel to the bottom plate 32 and/or the top plate 31 and provide a high through-flow in the vertical direction.

This ensures a low air resistance in that direction.

Figure 4C:
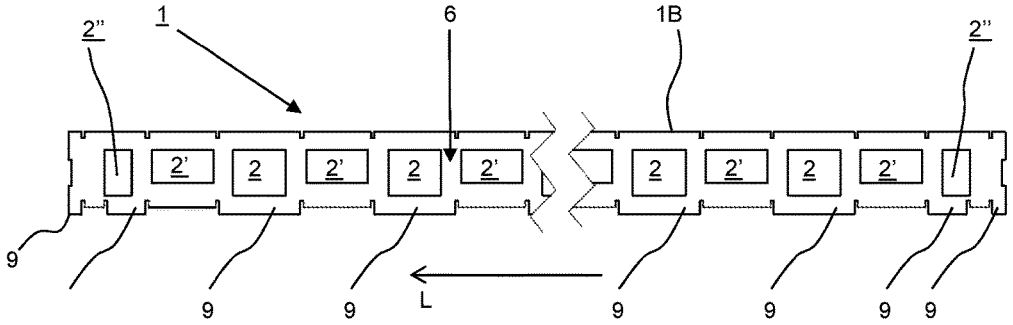
Figure 4D:
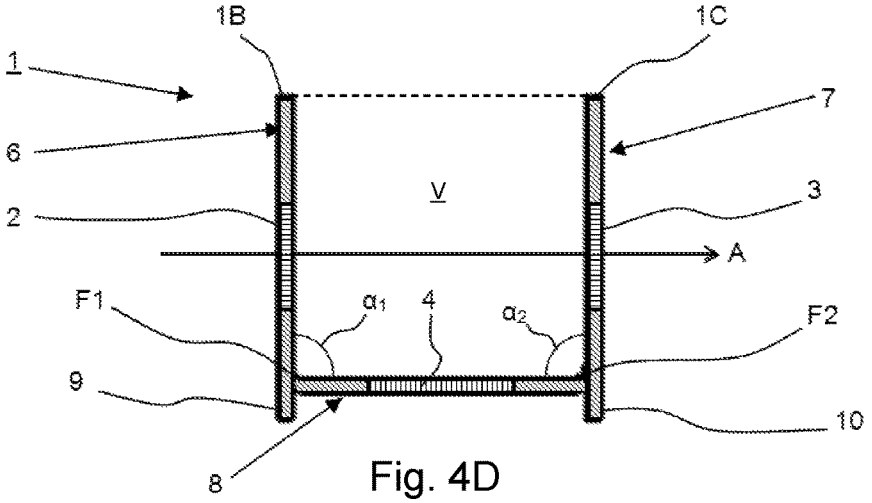

As shown in FIG. 4D, each of the longitudinal plate sections 6, 7 forms a leg or side section 6, 7 of the H-shaped cross-section of the spacer 1. The planar regions 6, 7 are provided with a plurality of punched through-holes 2, 2', 2", 3, 3'. These through-holes 2, 2', 2", 3, 3' enable a large air flow parallel to the plane of the top and bottom plates 31, 32 and perpendicular to the longitudinal direction L of the spacer 1. In FIG. 4B, the through-holes 2, 2', 2", 3, 3' are punched into a rectangular form, though in practice these may be provided in any desired shape. The dimensions and positions of the through-holes 2, 2', 2", 3, 3' in the plate material of the longitudinal plates 6, 7 is preferable selected to maintain a sufficiently rigid spacer 1. Thus, the positioning and dimensioning of the through-holes 2, 2', 2", 3, 3', 4, 4', 4" depends on the thickness and material properties of the plate material of the spacer 1. A variety of through-holes 2, 2', 2", 3, 3' may be applied to the planar region 6, 7 as can be seen in FIG. 4B. The type of through-hole 2, 2', 2", 3, 3' in a longitudinal plate section 6, 7 corresponds to the type of through-hole 4, 4', 4" in the connection bridge 8. Basically, the spacer 1 is divided into a plurality of longitudinally alternating regions, each with their own type of opening 2, 2', 2", 3, 3', 4, 4', 4".

The different through-holes 2, 2', 2" are shown in the side view in FIG. 4C. Through-holes 2 positioned longitudinally at a similar position as a support leg 9 comprises a relatively large size, specifically a larger height as measured perpendicular to the bend line F1, F2. Where plate material of the connection bridge 8 connects the two longitudinal plate sections 6, 7, the through-holes 2' are smaller, i.e. having a height smaller height than the through-holes 2, 2". This ensures the through-holes 2 do not extend in the bending region of the plate material around the bend lines F1, F2. The spacer 1 then remains sufficiently rigid for accurately controlled bending. At the longitudinal ends of the spacer 1, through-holes 2" of a different size may be provided to fit an opening 2" into the remainder of the plate surface 6 not occupied by the repeating openings 2, 2'.

FIG. 4D illustrates the H-shaped cross-section of the spacer 1. The cross-section comprises a top U-shape formed by the plate sections 6, 7 and the connection bridge 8 and an inverted U-shape formed by the support legs 9, 10 and the connection bridge 8. The connection bridge 8 is a longitudinal plate 8 which in use extends parallel to the bottom plate 32 of the vacuum table 30. The spacer 1 then rests on the bottom plate 32 with its support legs 9, 10. The support legs 9, 10 extend parallel to the longitudinal plates 6, 7, away from the connection bridge 8 onto the bottom plate 32. The longitudinal plates 6, 7 at either side of the spacer 1 connect to the sides of the connection bridge 8 at the bend lines F1, F2. The longitudinal plates 6, 7 are connected to the connection bridge 8 at an angle $\alpha_1$, $\alpha_2$ around the bend lines F1, F2. In FIG. 4D, the angles angle $\alpha_1$, $\alpha_2$ are right angles, though different angles may be applied. The first or left longitudinal plate 6 is positioned opposite and facing the second or right longitudinal plate 7 by bending it around the bend line F1. The second longitudinal plate 7 is then bent around bend line F2. The longitudinal plates 6, 7 may then be projected onto one another or be positioned symmetrical to one another. The longitudinal plates 6, 7 are then positioned with respect to one another, such that an air flow may pass in a straight line A through through-holes 2, 3 in the first and second longitudinal plates 6, 7.

Preferably, the bending positions the longitudinal plates 6, 7 with respect to one another, such that the through-holes 2, 3 allow an air flow to pass through them in a straight line A parallel to the plane of the connection bridge 8. The bent longitudinal plates 6, 7, preferably with the connection bridge 8, define the air flow volume V inside the spacer 1. The air flow volume V extends between the planar regions 6, 7 laterally, longitudinally, as well in the height direction (as indicated by the dashed line). Air may pass into the air flow volume V via the through-holes 2, 3, 4. The though-holes 2, 3 in the planar region 6, 7 extend at an angle $\alpha_1$, $\alpha_2$ with the plane of the bottom plate 32 and allow for air flow with little air resistance in the direction A. In the longitudinal direction L, the air flow volume V is substantially empty, resulting in a very low air resistance in that direction L. The bottom through-hole 4 is oriented parallel to the bottom plate 32 and results in a high through-flow in the vertical direction, i.e. perpendicular to the plane of the bottom plate 32 and/or the connection bridge 8. Thereby, the air resistance throughout the entire vacuum table 30 is reduced.

Figure 5A:
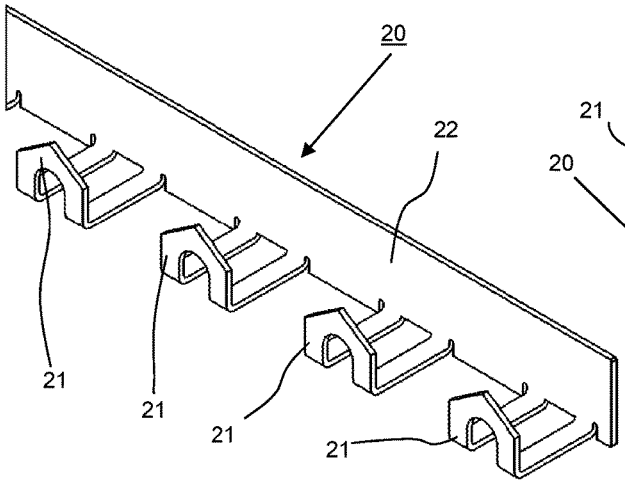
FIG. 5A is a perspective view of a spacer positioned according to the present invention.
Figure 5B:
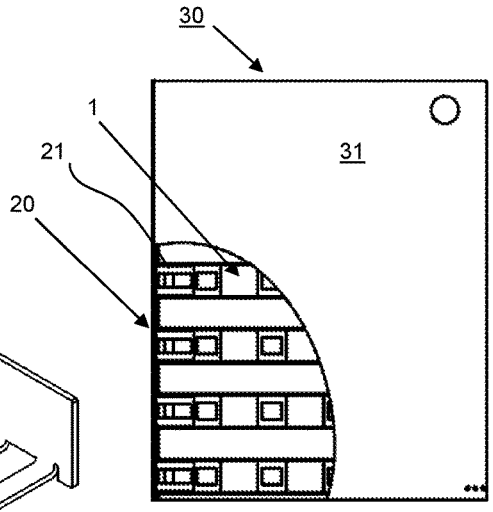
FIG. 5B is a top view of a cut-out of the vacuum table in FIG. 1.

FIG. 5A shows a spacer positioner 20 for positioning a plurality of spacers 1 at predefined distances to one another. The spacer positioner 20 comprises a base plate 22 which may be positioned against and/or parallel to the side plate 34 of the vacuum table 1. A plurality of positioning elements 21 extend from the base plate 22 at regular intervals. A positioning element 21 has substantially the same lateral width as the inner air flow volume V of the spacer 1, which allows the spacer 1 to be easily and securely positioned on and over the positioning element 21. At the free end of each positioning element 21, an upwardly directed guide element is provided to allow for an easy positioning of the spacer 1 on the positioning element 21. The guide element comprises an upwardly tapered end for engaging the spacer 1 and directing the spacer 1 along the guide element to a holding position on the positioning element 21. By mounting the spacer positioner 20 onto the top or bottom plate 31, 32 and subsequently placing the spacers 1 on the spacer positioners 20, a fast and simple assembly is achieved. The resulting assembly is illustrated in FIG. 5B, wherein a plurality of spacers 1 is regularly spaced apart by the spacer positioner 20. It will be appreciated that a spacer positioner 20 may be applied at one or both ends of the vacuum table 30.

Figure 6A:
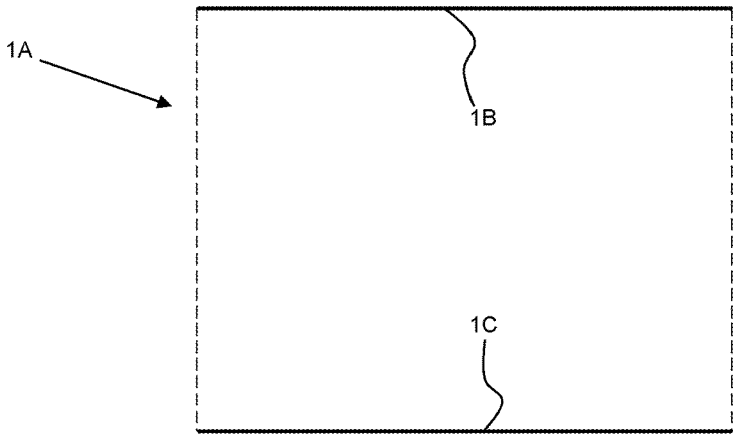
FIG. 6A-G illustrate the steps of forming a vacuum table in a method according to the present invention.
Figure 6B:
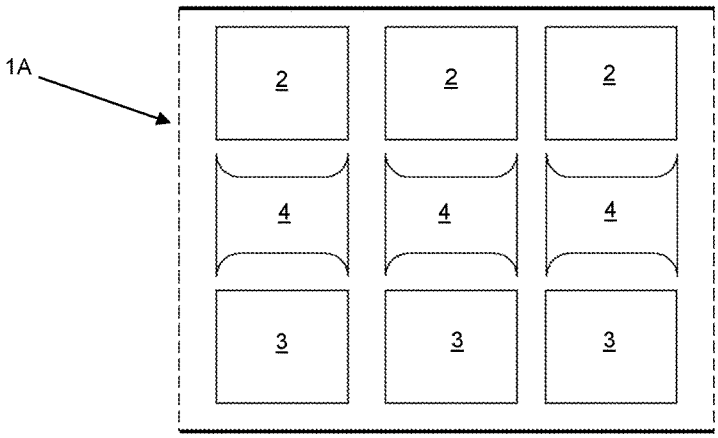
Figure 6C:
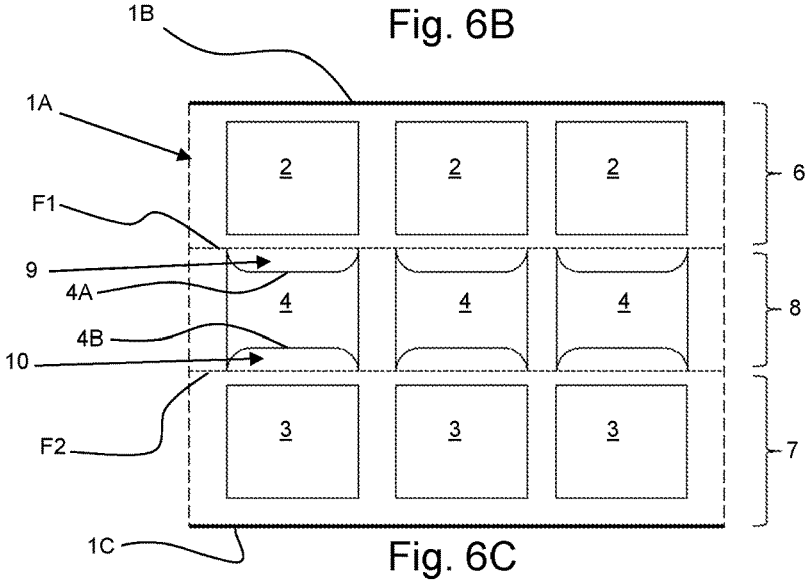
Figure 6D:
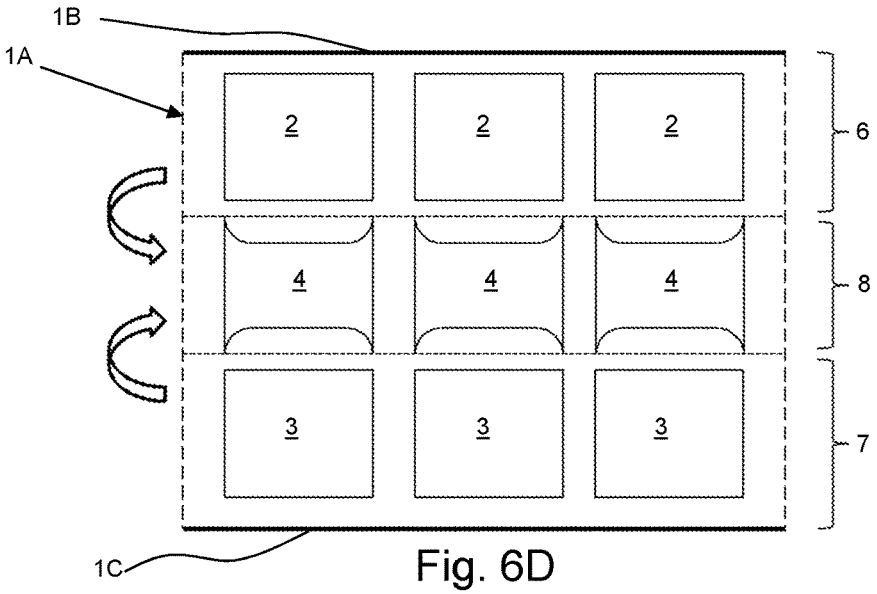
Figure 6E:
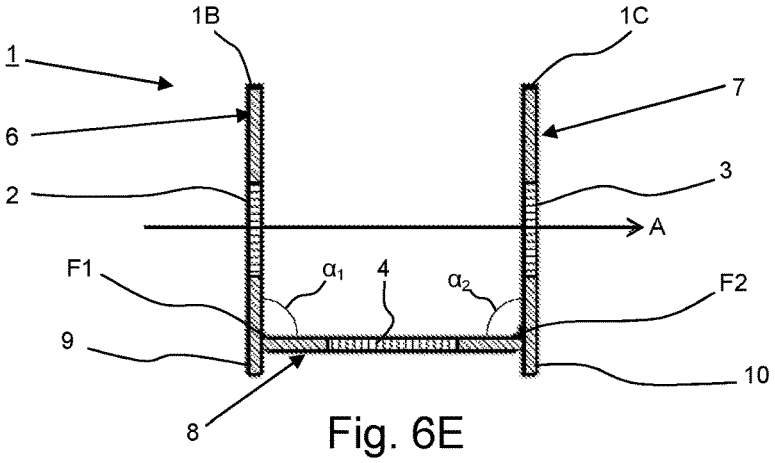
Figure 6F:
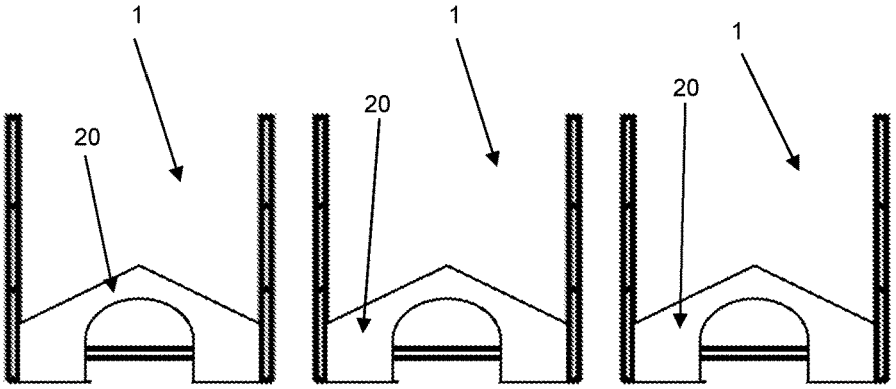
Figure 6G:
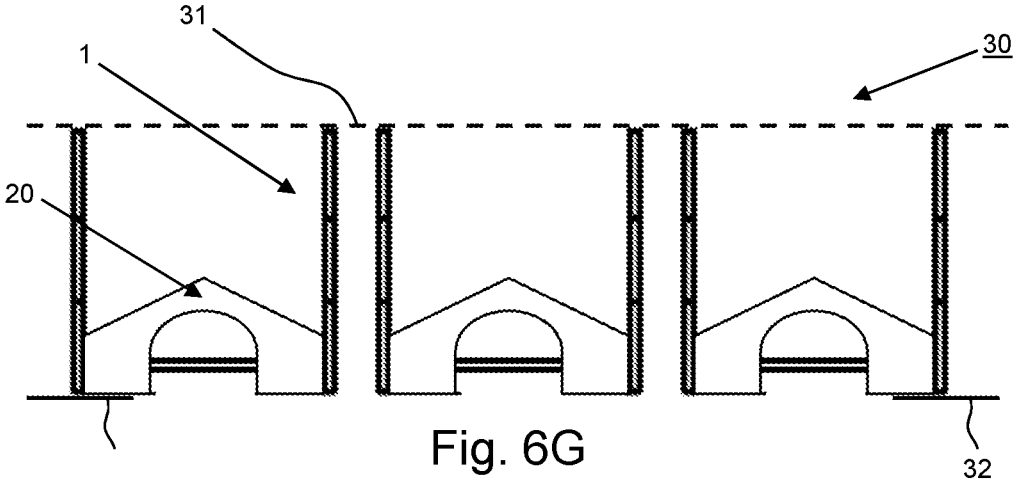
Figure 7:
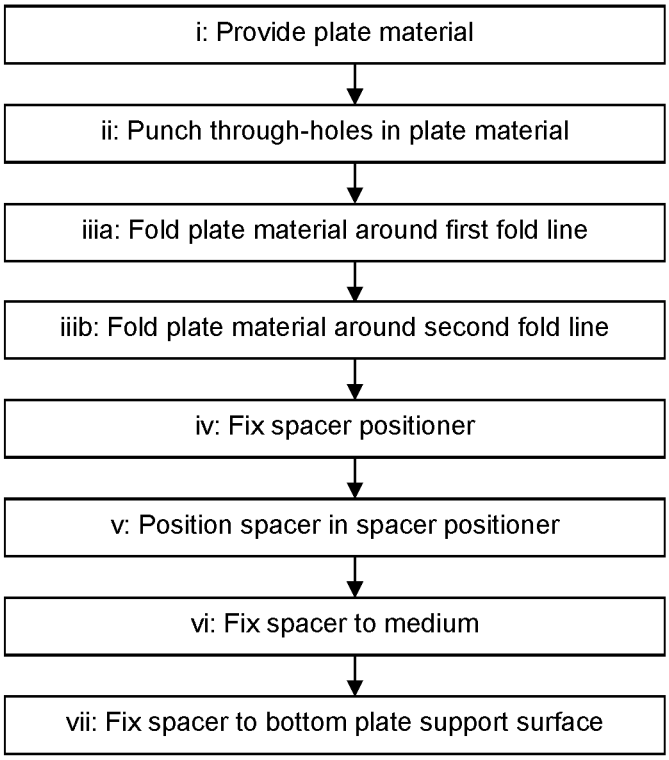
FIG. 7 is a diagram of the steps of forming a vacuum table in a method according to the present invention.

FIG. 6A-G along with FIG. 7 describe the different steps of the method according to the present invention. In step i and FIG. 6A a plate material 1A is provided. The plate material 1A is preferably rectangular in shape, for example a longitudinal strip 1A. Metal or other materials suitable for punching bending may be used for the plate material 1A. The plate material 1A is flat or planar and has a first and a second lateral side edge 1B, 1C.

In FIG. 6B, step ii is shown, wherein the plate material 1A is punched to form a plurality of air flow through-holes 2, 3, 4 in the plate material 1A. Three rows of through-holes 2, 3,4 can be seen extending in the length direction L of the plate material 1A. Through-holes 2, 3, 4 may be provided in any position or shape. In contrast to the upper and lower through-holes 2, 3, the middle or central through-holes 4 are curved to provide the support legs 9, 10.

FIG. 6C illustrates in more detail the configuration of the plate material 1A. The upper through-holes 2 are punched in a first longitudinal plate region 6 of the plate material 1A positioned between the upper lateral edge 1B and the first bend line F1. The bend line F1 extends parallel to the side edge 1B. Likewise, the lower through-holes 3 in FIG. 6C are positioned in between the second bend line F2 and the lower lateral edge 10. The connection bridge 8 is positioned and extends between the parallel bend lines F1, F2. A plurality of through-holes 4 with curved lateral side edges 4A, 4B are punched are punched in the central region of the connection element 8. Thereby, the connection bridges 8 are formed. The curved side edge 4A, 4B and the bend lines F1, F2 enclose the support legs 9, 10. The support legs 9, 10 extend away from the bend line F1, F2 into one of the through-holes 4.

In step iii, as shown in FIG. 6D, the plate material 1A is bent. The longitudinal plate 6 is bent along the bend line F1, such that the side edge 1B is rotated towards the side edge 10 in step iiia. Similarly, in step iiib the plate 7 is bent around bend line F2. By bending, the first and second longitudinal plates 6, 7 are positioned to face one another, such that one longitudinal plate 6, 7 may be projected onto the other. Thereto, the longitudinal plates 6, 7 are preferably bent over a straight angle $\alpha_1$, $\alpha_2$. Alternatively, the angle $\alpha_1$, $\alpha_2$ may be a skewed angle, preferably between 45 and 135°. The resulting U-shaped profile is shown in FIG. 6E, and was described in detail for FIG. 4D.

The spacer positioner 20 is preferably mounted on the top plate 31. It is preferred to assemble the vacuum table 30 by positioning the top plate 31 with the vacuum holes 31A on a flat assembly plane to obtain a substantially flat and even support surface 31. Such an "upside down" assembly will result in a well defined flat surface. Alternatively, the spacer positioner 20 may be mounted first on the bottom plate 32.

In step iv, the spacer positioner 20 is secured either onto the top or the bottom plate 31, 32, depending on the mode of assembly. In step v, the spacers 1 are mounted onto the spacer positioner 20, as shown in FIG. 6F. Thereby an array 11 of evenly distanced spacers 1 is obtained in a fast and reliable manner.

In steps and vi and vii, the spacers 1 are then fixed to the top or bottom plate 31, 32 against which the spacer positioner 20 was secured. The spacers 1 are preferably glued against the top or bottom plate 31, 32. However, when assembling the vacuum table 30 from the top plate 31 up in an "upside down" configuration, there is risk glue may drip or creep into the vacuum holes 31A under the influence of gravity. These contaminated vacuum holes 31A then require an additional cumbersome cleaning step. Contamination of the vacuum holes 31A can be avoided by positioning the supporting ends 1B, 1C of the spacers 1 between rows of vacuum holes 31A. Thereto, the spacing of the supporting 1B, 1C may be adjusting correspondingly to the spacing of the vacuum holes 31A. In a preferred embodiment, the spacing between the vacuum holes 31A is increased above each of the supporting ends 1B, 1C of the spacer 1, as can be seen in FIG. 3. The supporting ends 1B, 1C extend along the top plate without contacting any of the vacuum holes 31A. This prevents glue from running into the vacuum holes 31A adjacent the supporting ends 1B, 1C.

The vacuum table 30 is then connected to a suction system and assembled into a printing system.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A vacuum table for holding print media while printing, comprising:

a bottom plate;

a medium support surface spaced apart from the bottom plate and comprising a plurality of vacuum holes; and a spacer array comprising at least one monolithic spacer structure which is formed as a single piece, the at least monolithic spacer structure comprising:

a first and a second longitudinal plate positioned between the bottom plate and the medium support surface, wherein the first and second longitudinal plates comprise:

a plurality of air flow through-holes; and a top support edge and a bottom support edge formed by lateral sides of the first and the second longitudinal plates and extending equidistantly with respect to one another, such that a top support plane for the medium support surface is defined by the top support edges of the first and the second longitudinal plates and such that a bottom support plane for the bottom plate is defined by the bottom support edges of the first and the second longitudinal plate; and a connection element positioned between the first longitudinal plate and the second longitudinal plate when viewed parallel to the top and/or bottom support plane, which connection element connects the first longitudinal plate and the second longitudinal plate to one another, such that the connection element is positioned between the bottom support plane and the top support plane when viewed perpendicular to the top and/or bottom support plane.

2. The vacuum table according to claim 1, wherein the connection element, the first, and the second longitudinal plate are formed from a single element.

3. The vacuum table according to claim 2, wherein the connection element, the first longitudinal plate, and the second longitudinal plate are formed from a single plate element.

4. The vacuum table according to claim 2, wherein the connection element is connected to the first longitudinal plate and the second longitudinal plate at a connection point positioned between the top support edge and the bottom support edge of the first longitudinal plate and the second longitudinal plate.

5. The vacuum table according to claim 2, wherein the connection element is connected to the first longitudinal plate and the second longitudinal plate at such angles that the first longitudinal plate and the second longitudinal plate together with the connection element connected thereto form a stabile three-dimensional spacer structure.

6. The vacuum table according to claim 1, wherein the connection element, the first longitudinal plate, and the second longitudinal plate are formed from a single plate element.

7. The vacuum table according to claim 6, wherein the connection element is connected to the first longitudinal plate and the second longitudinal plate at a connection point positioned between the top support edge and the bottom support edge of the first longitudinal plate and the second longitudinal plate.

8. The vacuum table according to claim 6, wherein the connection element is connected to the first longitudinal plate and the second longitudinal plate at such angles that the first longitudinal plate and the second longitudinal plate together with the connection element connected thereto form a stabile three-dimensional spacer structure.

9. The vacuum table according to claim 1, wherein the connection element is connected to the first longitudinal plate and the second longitudinal plate at a connection point positioned between the top support edge and the bottom support edge of the first longitudinal plate and the second longitudinal plate.

10. The vacuum table according to claim 9, wherein the connection element is connected to the first longitudinal plate and the second longitudinal plate at such angles that the first longitudinal plate and the second longitudinal plate together with the connection element connected thereto form a stabile three-dimensional spacer structure.

11. The vacuum table according to claim 1, wherein the connection element is connected to the first longitudinal plate and the second longitudinal plate at such angles that the first longitudinal plate and the second longitudinal plate together with the connection element connected thereto form a stabile three-dimensional spacer structure.

12. The vacuum table according to claim 1, wherein:

the first longitudinal plate and second longitudinal plate comprise a plurality of support legs spaced apart from one another in a longitudinal direction of the first longitudinal plate and the second longitudinal plate; and free support ends of the support legs are aligned with respect to one another to define the bottom support edge.

13. The vacuum table according to claim 1, wherein the connection element comprises a connection bridge provided with at least one air flow through-hole.

14. The vacuum table according to claim 1, wherein the first longitudinal plate and the second longitudinal plate extend substantially parallel to one another, and wherein the connection element comprises a connection plate extending substantially perpendicular to a plane of the first longitudinal plate and of the second longitudinal plate.

15. The vacuum table according to claim 1, wherein the first longitudinal plate and the second longitudinal plate with the connection element connected thereto comprise a substantially H-shaped cross-sectional profile, wherein the side legs of the H-shape are formed by the first longitudinal plate and second longitudinal plate and the central portion of the H-shape is formed by the connection bridge.

16. The vacuum table according to claim 1, wherein the spacer structure is provided in between and connected to the bottom plate and the medium support surface as a spacer.

17. A spacer for use in the vacuum table according to claim 1, comprising an integrally formed spacer structure which comprises:

a first longitudinal plate and a second longitudinal plate, comprising:

a plurality of air flow through-holes; and a top support edge and bottom support edge formed by lateral sides of the first longitudinal plate and the second longitudinal plate, wherein the top support edge and bottom support edge extend equidistantly with respect to one another, such that a top support plane is defined by the top support edges of the first longitudinal plate and the second longitudinal plate and such that a bottom support plane is defined by the bottom support edges of the first and the second longitudinal plate; and a connection element positioned between the first longitudinal plate and the second longitudinal plate when viewed parallel to the top and/or bottom support plane, which connection element connects the first longitudinal plate and the second longitudinal plate to one another, wherein the connection element is connected to the first longitudinal plate and the second longitudinal plate between the top support edge and the bottom support edge of the first longitudinal plate and the second longitudinal plate when viewed perpendicular to the top and/or bottom support plane.

18. A method of forming the vacuum table according to claim 1 for a printing system, comprising the steps of:

punching a plate material to form a base plate comprising a longitudinal plate with plurality of air flow through-holes and substantially parallel and equidistant top and bottom support edges, wherein the base plate comprises a first and second longitudinal plate sections which are connected to one another via a connection plate section positioned between the first and second longitudinal plate section;

bending the first longitudinal plate section over a first angle around a first bend line positioned between the first longitudinal plate section and the connection plate section, such that the connection plate section is positioned in between the top and bottom support edges of the first longitudinal plate section when viewed perpendicular to said top and bottom support edges; and bending the second longitudinal plate section over a second angle around a second bend line positioned between the second longitudinal plate section and the connection plate section, such that the connection plate section is positioned in between the top and bottom support edges of the second longitudinal plate section when viewed perpendicular to said top and bottom support edges.

19. The method according to claim 18, wherein:

the step of punching further comprises punching a plurality of air flow through-holes in the connection plate section, wherein at least one of said air flow through-holes has a first curved through-hole edge intersecting the first bend line at two positions spaced apart along the first bend line, such that a first support leg is formed extending from the first longitudinal plate across the first bend line; and the step of bending the first longitudinal plate section further comprises bending the first longitudinal plate section around the first bend line, such that the first longitudinal plate section with the first support leg parallel thereto is positioned at the first angle with respect to the connection plate section.

20. The method according to claim 19, wherein:

at least one of the plurality of air flow through-holes punched in the connection plate section has a second curved through-hole edge intersecting the second bend line at two positions spaced apart along the second bend line, such that a second support leg is formed extending from the second longitudinal plate section across the second bend line; and the step of bending the second longitudinal plate section further comprises bending the second longitudinal plate section around the second bend line, such that the second longitudinal plate section with the second support leg parallel thereto is positioned at the second angle with respect to the connection plate section, wherein the top support edges of the first and second longitudinal plate sections are positioned in a top support plane and the bottom support edges of the first and second support legs are positioned in a bottom support plane substantially parallel to the top support plane.

* * * * *